US006997572B2

(12) United States Patent
Ono et al.

(10) Patent No.: US 6,997,572 B2
(45) Date of Patent: Feb. 14, 2006

(54) ILLUMINATION STRUCTURE FOR PUSHBUTTON AND ELECTRONIC DEVICE WITH PUSHBUTTON HAVING ILLUMINATION STRUCTURE

(75) Inventors: Shuichi Ono, Tokyo (JP); Mitsuru Kuroda, Tokyo (JP)

(73) Assignee: NEC Corporation, Tokyo (JP)

( * ) Notice: Subject to any disclaimer, the term of this patent is extended or adjusted under 35 U.S.C. 154(b) by 210 days.

(21) Appl. No.: 10/628,457

(22) Filed: Jul. 29, 2003

(65) Prior Publication Data

US 2004/0114341 A1 Jun. 17, 2004

(30) Foreign Application Priority Data

Aug. 12, 2002 (JP) ..... 2002-234636

(51) Int. Cl.
*H04M 1/22* (2006.01)

(52) U.S. Cl. ..... 362/24; 362/29; 362/30; 200/313; 200/314; 200/315; 200/316; 200/317; 341/22

(58) Field of Classification Search ..... 362/24, 362/29, 30; 200/313–317; 341/22
See application file for complete search history.

(56) References Cited

U.S. PATENT DOCUMENTS 5,711,588 A * 1/1998 Rudisill ..... 362/30

FOREIGN PATENT DOCUMENTS

| | | |
|---|---|---|
| EP | 0 554 084 | 8/1993 |
| EP | 0 593 804 | 4/1994 |
| EP | 0 939 414 | 9/1999 |
| JP | 4-8223 | 1/1992 |
| JP | 6-33335 | 4/1994 |
| JP | 6-68257 | 9/1994 |
| JP | 9-129078 | 5/1997 |
| JP | 2000-133072 | 5/2000 |
| JP | 2002-8478 | 1/2002 |

* cited by examiner

*Primary Examiner*—Thomas M. Sember
*Assistant Examiner*—James W Cranson, Jr.
(74) *Attorney, Agent, or Firm*—Young & Thompson

(57) ABSTRACT

A pushbutton switch mechanism has board 28 incorporating an electronic circuit thereon, metal sheet contact 26 disposed on board 28, a light-transmissive pushbutton disposed in an opening defined in a casing of the electronic device for being pressed from outside, the light-transmissive pushbutton having outer key top 22 and presser 25 formed with rubber sheet 24 for contacting metal sheet contact 26, and light-emitting elements 27 disposed on board 28 around presser 25 for applying light to a side surface of the presser 25. Presser 25 has a conical shape having an upper surface as a bottom surface substantially aligned with a lower surface of key top 22 and a vertex for contacting metal sheet contact 26. Light emitted from light-emitting elements 27 is applied to the entire side surface of presser 25.

15 Claims, 7 Drawing Sheets

ILLUMINATION STRUCTURE FOR PUSHBUTTON AND ELECTRONIC DEVICE WITH PUSHBUTTON HAVING ILLUMINATION STRUCTURE

BACKGROUND OF THE INVENTION

1. Field of the Invention

The present invention relates to an illumination structure for a pushbutton.

2. Description of the Related Art

Many devices including electronic devices which are required to be electrically operated have pushbuttons as function keys. Depending on environments and conditions in which to use pushbuttons, there are employed illuminated pushbutton switches with a lamp disposed in the switch. For example, illumination structures for pushbuttons are disclosed in Japanese laid-open utility model publications Nos. 4-8223, 6-33335, 6-68257, and Japanese laid-open patent publication 2002-8478. The illumination structure disclosed in Japanese laid-open utility model publication No. 4-8223 has a button and a protrusion on a lower side thereof which are integrally formed with a sheet. The protrusion on the lower side of the button directly presses a membrane switch or an electrically conductive contact. Light that is emitted from a light-emitting body disposed laterally of the protrusion passes through a diffusion plate and illuminates a lower slanted surface of the button. According to the illumination structure disclosed in Japanese laid-open utility model publication No. 6-33335, a presser disposed on a lower side of a lever-shaped button directly presses a click spring into contact with a contact. An LED is disposed closely to a hinged portion of the lever, and emits light that is applied through a curved surface of the lever below the hinged portion into the lever. According to the illumination structure disclosed in Japanese laid-open utility model publication No. 6-68257, a boss is mounted on a reverse surface of a button and constricted downwardly. The tip end of the boss presses a plunger of an illumination switch with an LED device housed therein, into contact with a contact. The illumination structure disclosed in Japanese laid-open patent publication No. 2002-8478, a key top has a lower flat surface for directly pressing a diaphragm contact. Light emitted from LEDs which are disposed around the key top enters the key top from a flat surface formed on the side of a key flange.

The above illumination structures, which are arranged such that the pushbutton directly presses the switch, are disadvantageous in that they are structurally complex and their components are of complicated shape.

To solve the above problems, there has been employed a simple illumination structure in which a light-transmissive soft rubber sheet having a presser for pressing a metal sheet contact is disposed over the entire surface of the button, and a key top molded of a transparent resin disposed in an opening of a front case is bonded to the rubber sheet. The key top can press the presser, and a side of the presser receives light emitted from light-emitting element disposed around the presser to illuminate the key top through the presser.

FIG. 1 of the accompanying drawings is a fragmentary cross-sectional view of a first conventional illumination structure for a pushbutton, which comprises a combination of a rubber sheet and a key top in an electronic device. A pushbutton switch mechanism of the electronic device has key top 72 molded of a transparent resin, light-transmissive soft rubber sheet 74 covering the pushbutton switch in its entirety, metal sheet contact 76, and light-emitting elements 77. Key top 72 has a flange engageable with an edge of an opening in a front case 71 of the electronic device for sliding movement only into the pushbutton switch. Rubber sheet 74 is secured to front case 71 and has presser 75 formed on its surface remote from key top 72 in positional alignment with key top 72. Key top 72 has a lower surface bonded to the upper surface of rubber sheet 74. Metal sheet contact 76 is disposed on board 78 at a position aligned with presser 75. Light-emitting elements 77 are disposed on board 78 in positions around presser 75.

With the above conventional illumination structure, as shown in FIG. 1, presser 75 formed on rubber sheet 74 for pressing metal sheet contact 76 is of a conical shape whose side surface has a large angle with respect to its bottom surface and hence has a small area. Therefore, light emitted from light-emitting elements 77 is applied laterally to the side surface of presser 75 of rubber sheet 74, so that only the side surface of the presser, indicated by the reference character D in FIG. 1, to which light is applied becomes highly illuminated. FIG. 2 of the accompanying drawings is a schematic view of conventional pushbutton 12 shown in FIG. 1, as seen from above. Since the area of the side surface of the conventional presser as seen from the above is small, when the illumination structure is viewed from outside thereof, as shown in FIG. 2, only the region corresponding to the side surface of the presser, which is shown hatched, provides a highly bright area E.

Other than the above structure in which the soft rubber sheet is bonded to the key top of a transparent resin, there is also employed a pushbutton illumination structure which uses a key sheet of the film type that comprises a thin film filled with a resin, rather than individual key tops.

FIG. 3 of the accompanying drawings is a fragmentary cross-sectional view of a second conventional illumination structure for a pushbutton, which comprises a combination of a rubber sheet and a key sheet in an electronic device. A pushbutton switch mechanism of the electronic device has a key sheet comprising transparent thin film 82 and light-transmissive filler resin 83 and covering the pushbutton in its entirety beneath front case 81, light-transmissive soft rubber sheet 84 disposed below the key sheet in covering relation to the overall key sheet, metal sheet contact 86 disposed on board 88, and light-emitting elements 87 disposed on board 88. Filler resin 83 of the key sheet is filled in a cylindrical shape in film 82 so as to have an upper surface projecting into film 82 to push film 82 upwardly within an opening in front case 81, thus providing a key surface, and a lower surface projecting as presser 85 from the film surface. Metal sheet contact 86 is disposed in a position aligned with presser 85, and light-emitting elements 87 are disposed in positions around presser 85.

With the above conventional illumination structure, too, as shown in FIG. 3, presser 85 of filler resin 83 for pressing metal sheet contact 86 is of a conical shape whose side surface has a large angle with respect to its bottom surface and hence has a small area. Therefore, light emitted from light-emitting elements 87 is applied laterally to rubber sheet 84 on the side surface of presser 85 of filler resin 83, so that only rubber sheet 85 on the side surface of the presser, indicated by the reference character F in FIG. 3, to which light is applied becomes highly illuminated. Consequently, when the illumination structure is viewed from outside thereof, as shown in FIG. 2, only the region corresponding to the side surface of the presser, which is shown hatched, provides a highly bright area E in a partial round pattern.

SUMMARY OF THE INVENTION

It is an object of the present invention to provide an illumination structure for a pushbutton which is capable of making the pushbutton highly illuminated uniformly, rather than highly illuminated partially, and an electronic device having such a pushbutton.

According to the present invention, an illumination structure for a pushbutton which operates as a function button in an electronic device, comprises a pushbutton switch mechanism having a board incorporating an electronic circuit thereon, a metal sheet contact disposed on the board, a light-transmissive pushbutton disposed in an opening defined in a casing of the electronic device for being pressed from outside, the light-transmissive pushbutton having an outer button and a presser connected to the outer button and disposed closer to the board for contacting the metal sheet contact, and a light-emitting element disposed on the board around the presser for applying light to a side surface of the presser, the presser having a conical shape having an upper surface as a bottom surface substantially aligned with a lower surface of the button and a vertex for contacting the metal sheet contact.

The button of the pushbutton may comprise a key top molded of a transparent resin and having a flange engageable with an edge of the opening in the casing for sliding movement only into the pushbutton switch, and the presser comprises a light-transmissive rubber sheet secured to the casing and covering the pushbutton in its entirety in the casing and having a protrusion projecting remotely from the button in positional alignment with the button, the lower surface of the button being bonded to the upper surface of the presser.

The pushbutton may comprise a transparent thin film secured to the casing in covering relation to an interior space in the casing, a light-transmissive filler resin, and a light-transmissive soft rubber sheet secured to the casing in covering relation to the interior space in the casing beneath the filler resin, the filler resin being filled in the film so as to have an upper surface projecting into the film to push the film upwardly within the opening in the casing, the upper surface and the film jointly serving as the button, and a lower surface projecting from the button and cooperating with the rubber sheet in forming the presser, the film and the filler resin jointly serving as a key sheet which provides interconnected individual buttons, the film having an upper surface bonded to a lower surface of the casing, and a lower surface bonded to an upper surface of the rubber sheet.

The button may have a cylindrical shape and the presser may have a substantially conical shape. Alternatively, the button may have a prismatic shape and the presser may have a substantially pyramidal shape.

According to the present invention, an electronic device has an illuminated pushbutton and an illuminating structure for the illuminated pushbutton, the illuminating structure comprising an illumination structure described above. The electronic device may be used as a cellular phone unit.

According to the present invention, an electronic device has one or more pushbuttons which can be made illuminated by light-emitting elements disposed in the electronic device. The pushbutton has a presser for pressing a button contact, the presser being of a convex shape having a large taper angle to allow a side surface thereof to have a large area, so that the button can be illuminated uniformly when viewed from above.

The above and other objects, features, and advantages of the present invention will become apparent from the following description based on the accompanying drawings which illustrate preferred embodiments of the present invention.

DETAILED DESCRIPTION OF THE PREFERRED EMBODIMENTS

Figure 1:
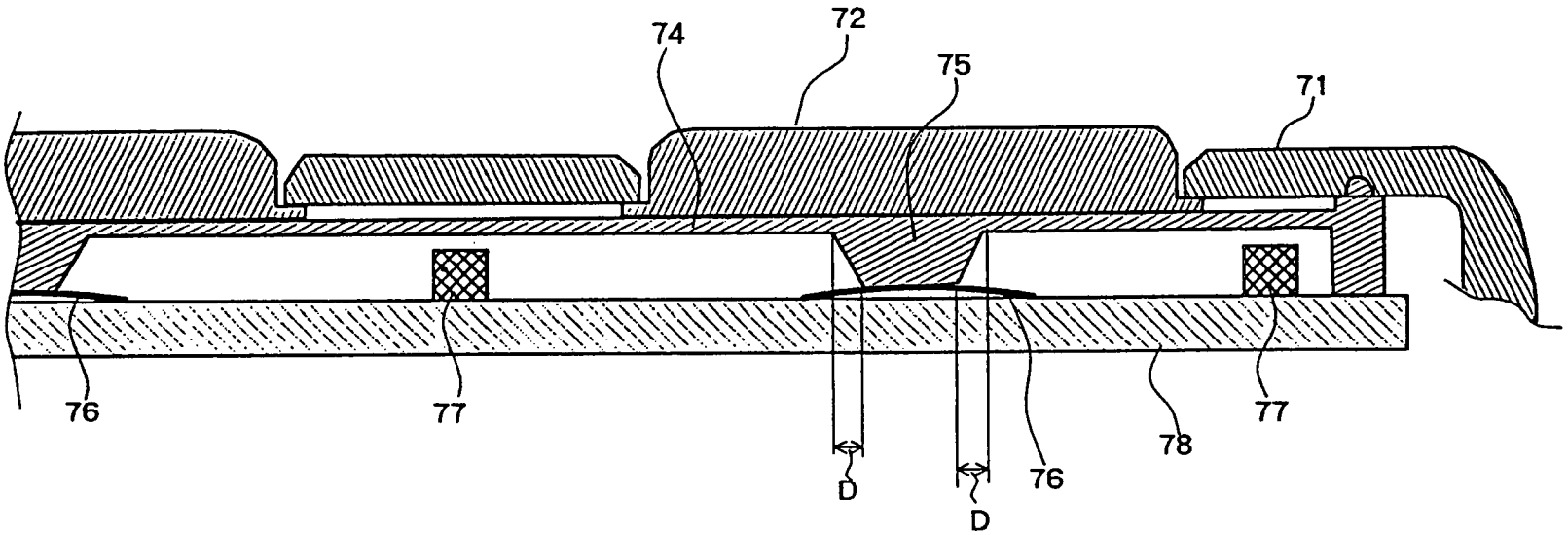
Fig.1 Prior Art
FIG. 1 is a fragmentary cross-sectional view of a first conventional illumination structure for a pushbutton, which comprises a combination of a rubber sheet and a key top in an electronic device.
Figure 2:
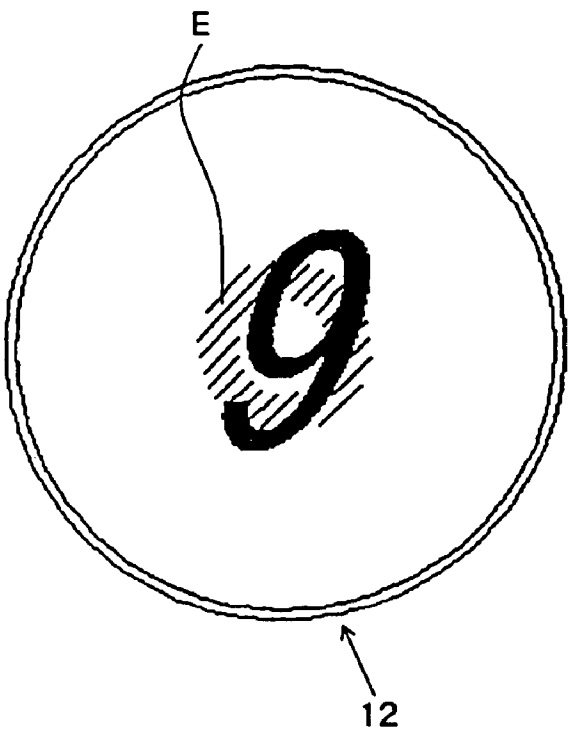
Fig. 2 Prior Art
FIG. 2 is a schematic view of conventional pushbutton 12 shown in FIG. 1, as seen from above.
Figure 2:
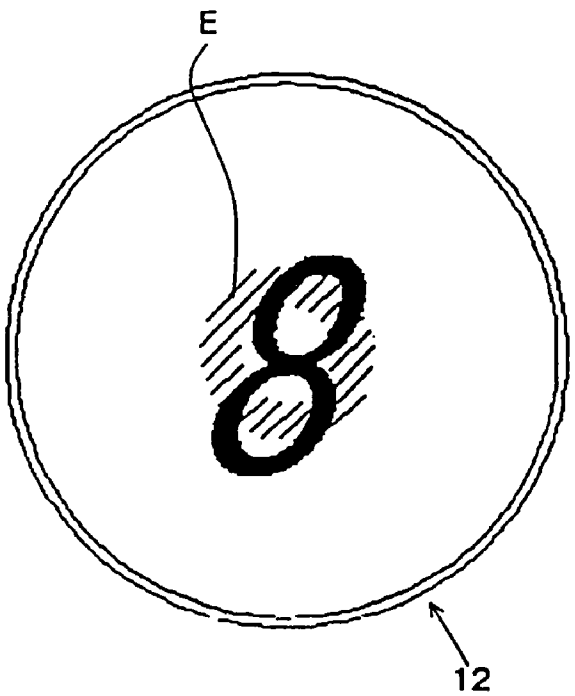
Fig. 2 Prior Art
Figure 3:
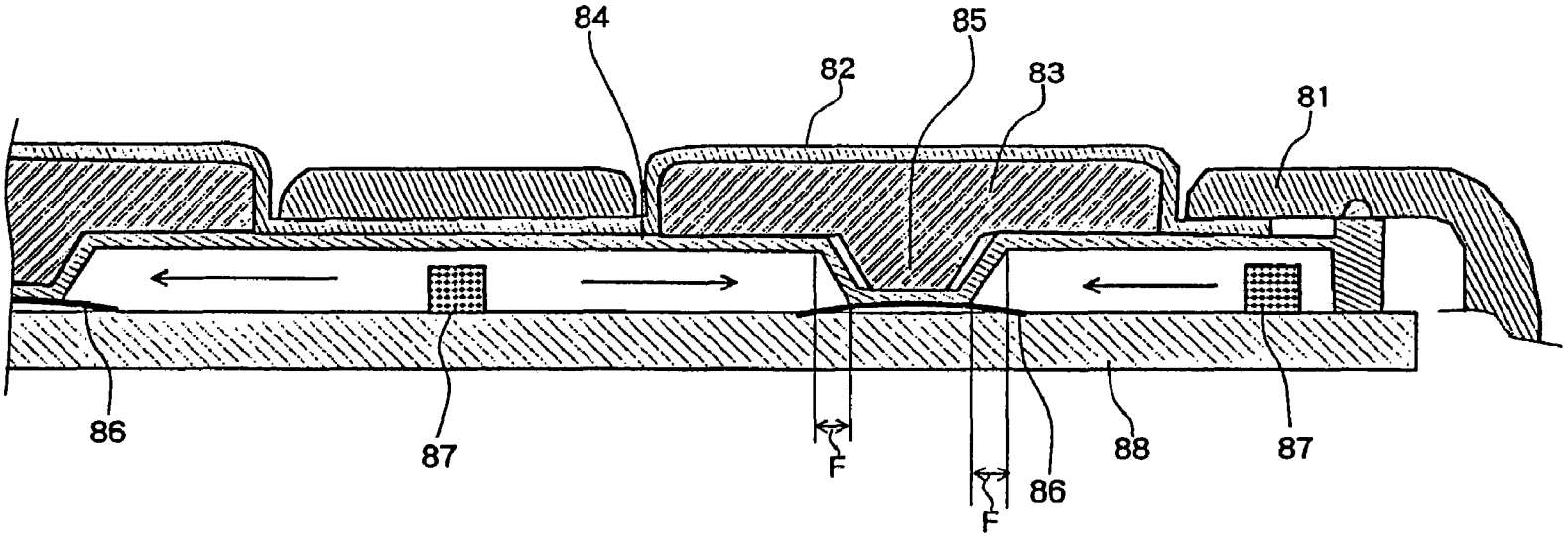
Fig. 3 Prior Art
FIG. 3 is a fragmentary cross-sectional view of a second conventional illumination structure for a pushbutton, which comprises a combination of a rubber sheet and a key sheet in an electronic device.
Figure 4A:
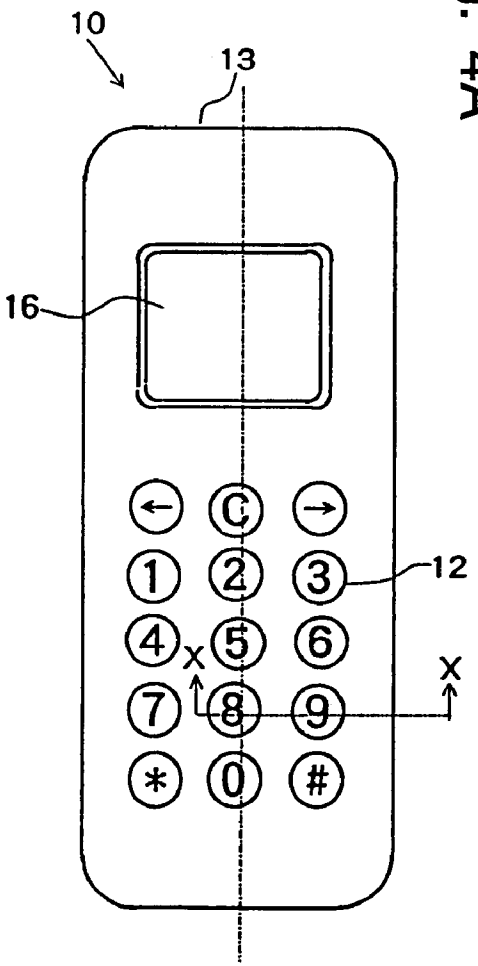
FIG. 4A is a plan view of an electronic device according to an embodiment of the present invention.
Figure 4B:
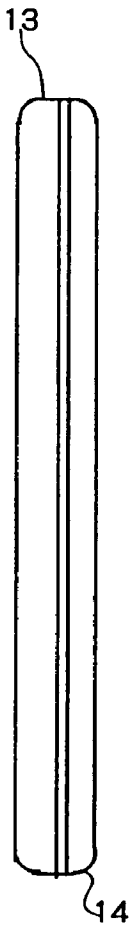
FIG. 4B is a side elevational view of the electronic device according to the embodiment of the present invention.
Figure 4C:
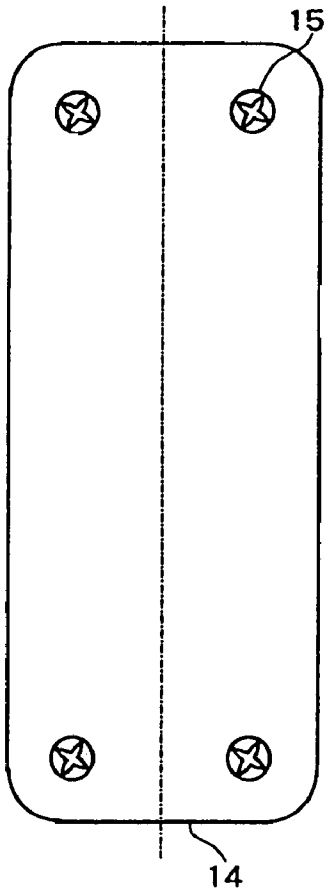
FIG. 4C is a bottom view of the electronic device according to the embodiment of the present invention.

Embodiments of the present invention will be described below. FIG. 4A is a plan view of an electronic device according to an embodiment of the present invention, FIG. 4B is a side elevational view of the electronic device according to the embodiment of the present invention, and FIG. 4C is a bottom view of the electronic device according to the embodiment of the present invention. In the embodiments, a cellular phone unit will be described as the electronic device. However, the present invention is not limited to such a cellular phone unit, but may be applied to all electronic devices which need illuminated pushbuttons.

Electronic device 10 has a casing comprising front case 13 and rear case 14 which are fastened to each other by a plurality of screws 15. Front case 13 supports thereon display panel 16 and one or more illuminated pushbuttons 12. Illuminated pushbuttons 12 can be lighted when necessary for the user to confirm information such as numerals or the like displayed on pushbuttons 12 even in a dark room.

Figure 5:
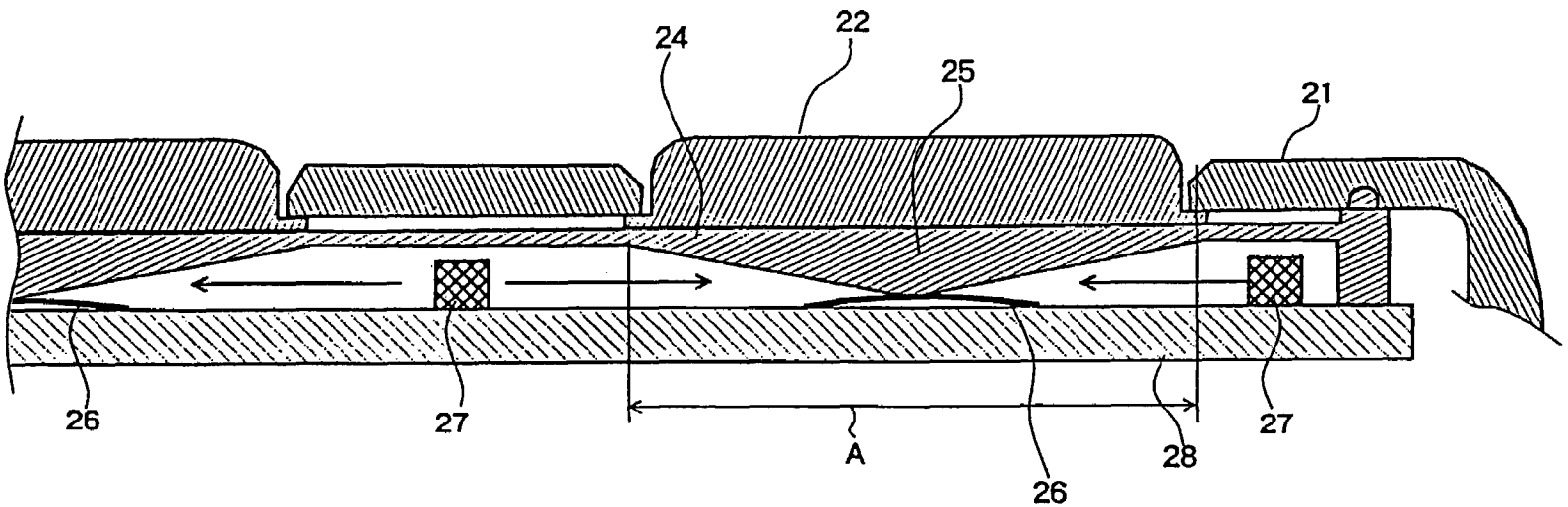
FIG. 5 is a fragmentary cross-sectional view taken along line X—X of FIG. 4A, showing an illumination structure for a pushbutton, which comprises a combination of a rubber sheet and a key top in an electronic device according to a first embodiment of the present invention.

FIG. 5 is a fragmentary cross-sectional view taken along line X—X of FIG. 4A, showing an illumination structure for a pushbutton, which comprises a combination of a rubber sheet and a key top in an electronic device according to a first embodiment of the present invention. A pushbutton switch mechanism of the electronic device has key top 22 molded of a transparent resin and having a flange engageable with an edge of an opening in front case 21 of the electronic device for sliding movement only into the pushbutton switch, light-transmissive soft rubber sheet 24 covering the pushbutton switch in its entirety, board 28 incorporating an electronic circuit thereon, metal sheet contact 26 comprising a thin metal sheet pressed to a dome shape and disposed on board 28 in a position aligned with presser 25, and light-emitting elements 27 disposed on board 28 in positions around presser 25. Rubber sheet 24 is secured to front case 21 and has presser 25 formed on its surface remote from key top 22 in positional alignment with key top 22. Key top 22 has a lower surface bonded to the upper surface of rubber sheet 24.

Figure 6:
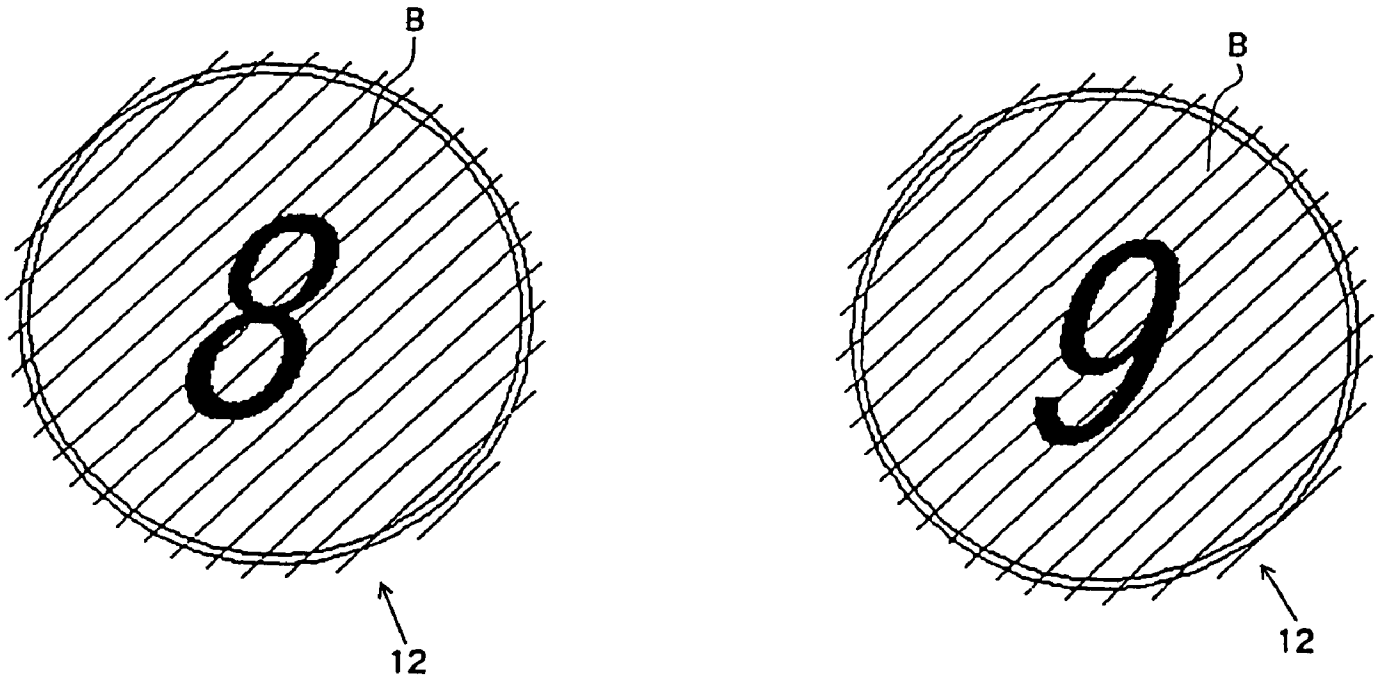
FIG. 6 is a schematic view of the pushbutton according to the first embodiment shown in FIG. 5, as seen from above.

With the electronic device according to the first embodiment, as shown in FIG. 5, presser 25 formed on rubber sheet 24 for pressing metal sheet contact 26 is of a conical shape whose side surface is inclined at a small angle with respect to its bottom surface and hence has a large area. Therefore, light emitted from light-emitting elements 27 is applied laterally to the side surface of presser 25 of rubber sheet 24, so that the entire side surface of presser 25, indicated by the reference character A in FIG. 5, to which light is applied becomes highly illuminated. FIG. 6 is a schematic view of pushbutton 12 according to he first embodiment shown in FIG. 5, as seen from above. Since the area of the side surface of the presser according to the first embodiment as seen from the above is large, when the illumination structure is viewed from outside thereof, as shown in FIG. 6, the overall pushbutton, which is shown hatched, provides a highly bright area B.

The present invention is also applicable to a pushbutton illumination structure having a film-type key sheet comprising a thin film filled with a resin, rather than individual key tops, in addition to the above structure in which the soft rubber sheet is bonded to the key top molded of the transparent resin.

Figure 7:
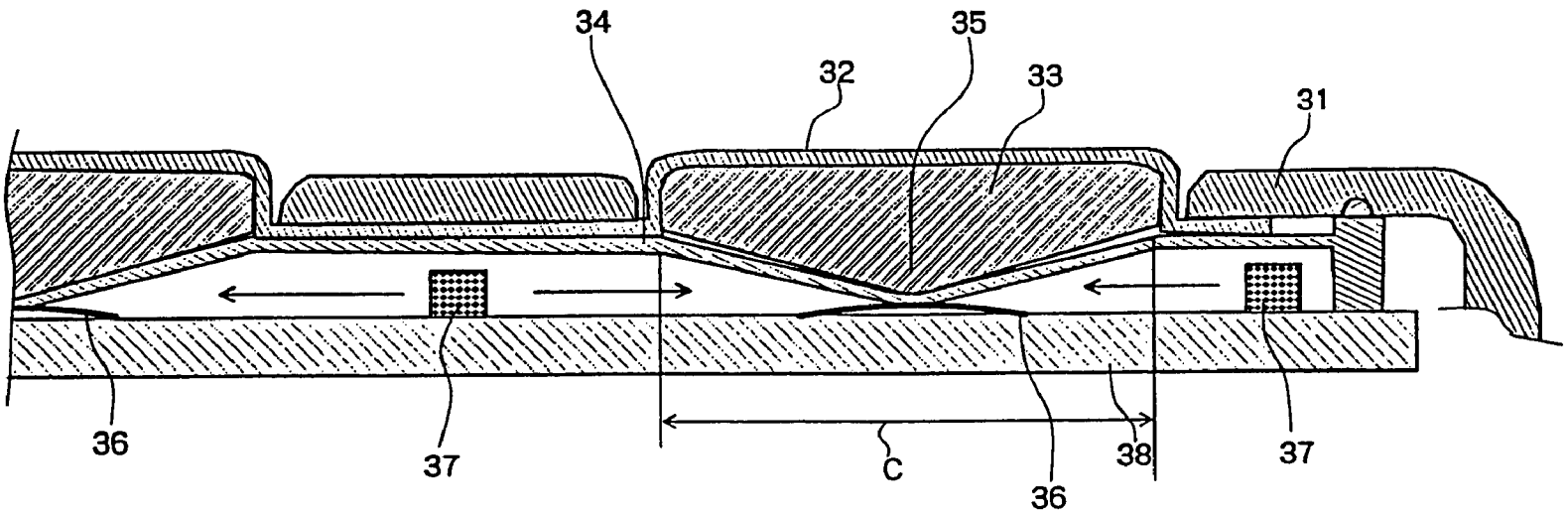
FIG. 7 is a fragmentary cross-sectional view taken along line X—X of FIG. 4A, showing an illumination structure for a pushbutton, which comprises a combination of a rubber sheet and a key sheet in an electronic device according to a second embodiment of the present invention.

FIG. 7 is a fragmentary cross-sectional view taken along line X—X of FIG. 4A, showing an illumination structure for a pushbutton, which comprises a combination of a rubber sheet and a key sheet in an electronic device according to a second embodiment of the present invention. A pushbutton switch mechanism of the electronic device has a key sheet comprising transparent thin film 32 and light-transmissive filler resin 33 and covering the pushbutton area in its entirety beneath front case 31, light-transmissive soft rubber sheet 34 disposed below the key sheet in covering relation to the overall key sheet, board 38 incorporating an electronic circuit thereon, metal sheet contact 36 comprising a thin metal sheet pressed to a dome shape and disposed on board 38, and light-emitting elements 37 disposed on board 38. Filler resin 33 of the key sheet is filled in film 32 so as to have an upper surface projecting in a cylindrical shape into film 32 to push film 32 upwardly within an opening in front case 31, thus providing a key surface, and a lower surface projecting as conical presser 35 from the film surface. Metal sheet contact 36 is disposed in a position aligned with presser 35, and light-emitting elements 37 are disposed in positions around presser 35.

With the electronic device according to the second embodiment, too, as shown in FIG. 7, presser 35 formed on filler resin 33 for pressing metal sheet contact 36 is of a conical shape whose side surface is inclined at a small angle with respect to its bottom surface and hence has a large area. Therefore, light emitted from light-emitting elements 37 is applied laterally to the side surface of rubber sheet 34 which is held against presser 35 of filler resin 33, so that the entire side surface of rubber sheet 34 which is held against presser 35 of filler resin 33, indicated by the reference character C in FIG. 7, to which light is applied becomes highly illuminated. Therefore, when the illumination structure is viewed from outside thereof, as shown in FIG. 6, the overall pushbutton, which is shown hatched, provides a highly bright area B.

While the pushbutton has been described as having a circular shape, the pushbutton is not limited to such a shape, but may be of a rectangular shape. The pushbutton of a rectangular shape may have a presser having a pyramidal shape.

As described above, the illuminated pushbutton switch according to the present invention is advantageous in that the pushbutton becomes uniformly illuminated in its entirety. This is because the side surface of the presser or the side surface of the rubber sheet disposed outside of the presser, to which light from the light-emitting elements is applied laterally, is of a conical shape such that the side surface is inclined at a small angle to the bottom surface of the presser and has a large area, allowing light from the light-emitting elements to be applied to the entire lower side of the pushbutton.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. An illumination structure for a pushbutton which operates as a function button in an electronic device, comprising:

a pushbutton switch mechanism having a board incorporating an electronic circuit thereon, a metal sheet contact disposed on said board, a light-transmissive pushbutton disposed in an opening defined in a casing of said electronic device for being pressed from outside, said light-transmissive pushbutton having an outer button and a presser connected to said outer button and disposed closer to said board for contacting said metal sheet contact, and a light-emitting element disposed on said board around said presser for applying light to a side surface of said presser, said presser having a conical shape having an upper surface as a bottom surface substantially aligned with a lower surface of said button and a vertex for contacting said metal sheet contact.

2. An illumination structure according to claim 1, wherein said button has a cylindrical shape and said presser has a substantially conical shape.

3. An illumination structure according to claim 1, wherein said button has a prismatic shape and said presser has a substantially pyramidal shape.

4. An electronic device having an illuminated pushbutton and an illuminating structure for the illuminated pushbutton, said illuminating structure comprising an illumination structure according to claim 1.

5. An electronic device according to claim 4, for use as a cellular phone unit.

6. An illumination structure according to claim 1, wherein said button of said pushbutton comprises a key top molded of a transparent resin and having a flange engageable with an edge of said opening in said casing for sliding movement only into the pushbutton switch, and said presser of said pushbutton comprises a light-transmissive rubber sheet secured to said casing and covering said pushbutton in its entirety in said casing and having a protrusion projecting remotely from said button in positional alignment with said button, the lower surface of said button being bonded to the upper surface of said presser.

7. An illumination structure according to claim 6, wherein said button has a cylindrical shape and said presser has a substantially conical shape.

8. An illumination structure according to claim 6, wherein said button has a prismatic shape and said presser has a substantially pyramidal shape.

9. An electronic device having an illuminated pushbutton and an illuminating structure for the illuminated pushbutton, said illuminating structure comprising an illumination structure according to claim 6.

10. An electronic device according to claim 9, for use as a cellular phone unit.

11. An illumination structure according to claim 1, wherein said pushbutton comprises a transparent thin film secured to said casing in covering relation to an interior space in the casing, a light-transmissive filler resin, and a light-transmissive soft rubber sheet secured to said casing in covering relation to the interior space in the casing beneath said film and said filler resin, said filler resin being filled in said film so as to have an upper surface projecting into said film to push the film upwardly within the opening in said casing, said upper surface and said film jointly serving as said button, and a lower surface projecting from said button and cooperating with said rubber sheet in forming said presser, said film and said filler resin jointly serving as a key sheet which provides interconnected individual buttons, said film having an upper surface bonded to a lower surface of said casing, and a lower surface bonded to an upper surface of said rubber sheet.

12. An illumination structure according to claim 11, wherein said button has a cylindrical shape and said presser has a substantially conical shape.

13. An illumination structure according to claim 11, wherein said button has a prismatic shape and said presser has a substantially pyramidal shape.

14. An electronic device having an illuminated pushbutton and an illuminating structure for the illuminated pushbutton, said illuminating structure comprising an illumination structure according to claim 11.

15. An electronic device according to claim 14, for use as a cellular phone unit.

* * * * *